US010202874B2

(12) United States Patent
Kim et al.

(10) Patent No.: US 10,202,874 B2
(45) Date of Patent: Feb. 12, 2019

(54) SUPERCRITICAL $CO_2$ GENERATION SYSTEM APPLYING PLURAL HEAT SOURCES

(71) Applicant: Doosan Heavy Industries & Construction Co., Ltd., Gyeongsangnam-do (KR)

(72) Inventors: Hak Soo Kim, Gyeonggi-do (KR); Song Hun Cha, Gyeonggi-do (KR); Sang Hyeun Kim, Gyeonggi-do (KR); Jun Tae Jang, Seoul (KR)

(73) Assignee: Doosan Heavy Industries & Construction Co., Ltd., Changwon-si, Gyeongsangnam-do (KR)

( * ) Notice: Subject to any disclaimer, the term of this patent is extended or adjusted under 35 U.S.C. 154(b) by 69 days.

(21) Appl. No.: 15/431,273

(22) Filed: Feb. 13, 2017

(65) Prior Publication Data

US 2017/0234170 A1 Aug. 17, 2017

(30) Foreign Application Priority Data

Feb. 11, 2016 (KR) ..... 10-2016-0015482

(51) Int. Cl.
*F01K 25/10* (2006.01)
*F01K 7/16* (2006.01)
*F01K 11/02* (2006.01)

(52) U.S. Cl.
CPC ..... *F01K 25/103* (2013.01); *F01K 7/16* (2013.01); *F01K 11/02* (2013.01)

(58) Field of Classification Search
CPC . F01K 7/16; F01K 7/32; F01K 23/064; F01K 23/10; F01K 25/103
See application file for complete search history.

(56) References Cited

U.S. PATENT DOCUMENTS

2006/0112692 A1 6/2006 Sundel
2012/0131920 A1* 5/2012 Held ..... F01K 13/02 60/650
2014/0208750 A1 7/2014 Vermeersch et al.

FOREIGN PATENT DOCUMENTS

JP 58-057013 A 4/1983
JP H06-042703 A 2/1994
(Continued)

OTHER PUBLICATIONS

International Search Report in International Application No. PCT/KR2017/001241, filed Feb. 5, 2017.

*Primary Examiner* — Jonathan Matthias
(74) *Attorney, Agent, or Firm* — Saliwanchik, Lloyd & Eisenschenk

(57) ABSTRACT

The present invention relates to the supercritical $CO_2$ generation system applying plural heat sources. The supercritical $CO_2$ generation system applying plural heat sources includes a pump circulating a working fluid; a plurality of heat exchangers heating the working fluid using an external heat source and including a plurality of constrained heat sources having an emission regulation condition of an outlet end thereof and a plurality of general heat sources without the emission regulation condition; a plurality of turbines operated by the working fluid heated by passing through the heat exchangers; and a plurality of recuperators cooling the working fluid passing through the turbines by heat exchange between the working fluid passing through the turbines and the working fluid passing through the pump, wherein the working fluid passing through the turbine is branched into the recuperators, respectively.

20 Claims, 1 Drawing Sheet

(56) References Cited

FOREIGN PATENT DOCUMENTS

| | | | |
|---|---|---|---|
| JP | 2012145092 | A | 8/2012 |
| KR | 10-2014-0064704 | A | 5/2014 |

* cited by examiner

SUPERCRITICAL $CO_2$ GENERATION SYSTEM APPLYING PLURAL HEAT SOURCES

CROSS-REFERENCE TO RELATED APPLICATION

This application claims priority under 35 U.S.C. § 119 to Korean Patent Application No. 10-2016-0015482, filed Feb. 11, 2016, which is herein incorporated by reference in its entirety.

BACKGROUND OF THE INVENTION

Field of the Invention

Exemplary embodiments of the present invention relate to a supercritical $CO_2$ generation system applying plural heat sources, more particularly, to a supercritical $CO_2$ generation system applying plural heat sources capable of efficiently disposing and operating a heat exchanger according to a condition of the heat sources.

Description of the Related Art

As the need to efficiently produce power is gradually increased, and a move to decrease emission of pollutants has become active globally, various efforts for increasing power production while decreasing emission of pollutants have been made. As one of such efforts, research and development of a power generation system using supercritical $CO_2$ as a working fluid as disclosed in Japanese Patent Laid-Open Publication No. 2012-145092 has been actively conducted.

Supercritical $CO_2$ has a similar density to a liquid state and similar viscosity to gas, thus it is possible to implement miniaturization of a device and significantly decrease power consumption required for compression and circulation of a fluid. At the same time, supercritical $CO_2$ has a critical point at 31.4° C. and 72.8 atm, which is much lower than that of water having a critical point at 373.95° C. and 217.7 atm, and thus may be easily handled. The supercritical $CO_2$ generation system shows pure power generation efficiency of about 45% when being operated at 550° C. The supercritical $CO_2$ generation system may improve generation efficiency by 20% or more as compared to that of the existing steam cycle, and may reduce a size of a turbine device.

When plural constrained heat sources are applied as a heat source, since a system configuration is complicated and it is difficult to effectively use heat, most of the supercritical $CO_2$ generation systems generally have one heater as a heat source. Therefore, the system configuration is restrictive, and it is difficult to effectively use the heat source.

BRIEF SUMMARY

The present invention provides a supercritical $CO_2$ generation system applying plural heat sources capable of efficiently disposing and operating a heat exchanger according to a condition of the heat source.

Other aspects of the present invention can be understood by the following description, and become apparent with reference to the embodiments of the present invention. Also, it is obvious to those skilled in the art to which the present invention pertains that benefits of the present invention can be realized by the means as claimed and combinations thereof.

In accordance with one aspect of the present invention, a supercritical $CO_2$ generation system applying plural heat sources comprises: a pump circulating a working fluid; a plurality of heat exchangers heating the working fluid using an external heat source and including a plurality of constrained heat sources having an emission regulation condition of an outlet end thereof and a plurality of general heat sources without the emission regulation condition; a plurality of turbines operated by the working fluid heated by passing through the heat exchangers; and a plurality of recuperators cooling the working fluid passing through the turbines by heat exchange between the working fluid passing through the turbines and the working fluid passing through the pump, wherein the working fluid passing through the turbine is branched into the recuperators, respectively.

The emission regulation condition may be a temperature condition.

The number of recuperators may be equal to the number of heat exchangers or may be less than the number of heat exchangers to transfer the working fluid to the heat exchanger and at least one of the recuperators may exchange heat between the working fluid passing through the turbine and the working fluid passing through the pump.

The turbine may include a low pressure turbine operating the pump and a high pressure turbine operating a generator, and an integrated flow rate $mt_0$ of the working fluid passing through the low pressure turbine and the high pressure turbine may be branched and supplied to the plurality of recuperators.

The recuperators may include a first recuperator to a third recuperator and may further include a branch point branched from rear ends of the low pressure turbine and the high pressure turbine to the third recuperator, and a three way valve provided at a rear end of the branch point branched to the third recuperator to be provided at branch points branched to the first recuperator and the second recuperator, respectively.

The heat exchangers may include a first constrained heat exchanger and a second constrained heat exchanger, and when any one of the first constrained heat exchanger and the second constrained heat exchanger has an emission regulation condition having a temperature higher than that of the other thereof, an integrated flow rate $mt_0$ of the working fluid transferred to the heat exchanger having the emission regulation condition of the higher temperature of the first constrained heat exchanger and the second constrained heat exchanger may be less than the integrated flow rate $mt_0$ of the working fluid transferred to the heat exchanger having the emission regulation condition of the lower temperature thereof.

When the first constrained heat exchanger and the second constrained heat exchanger have an emission regulation condition of the same temperature, the integrated flow rate $mt_0$ of the working fluid may be equally distributed to the first constrained heat exchanger and the second constrained heat exchanger.

The heat exchangers may further include a first heat exchanger and a second heat exchanger, a front end of the pump may be further provided with a cooler cooling the working fluid passing through the recuperator, and a part of the working fluid passing through the pump may be branched from a front end of the second recuperator to be supplied to each of the first heat exchanger and the second heat exchanger and heated and then supplied to the low pressure turbine and the high pressure turbine.

The working fluid passing through the first constrained heat exchanger and the second constrained heat exchanger may be introduced into the turbine.

In accordance with another aspect of the present invention, a supercritical $CO_2$ generation system applying plural heat sources comprises: a pump circulating a working fluid; a plurality of heat exchangers heating the working fluid using an external heat source and including a plurality of constrained heat sources having an emission regulation condition of an outlet end thereof and a plurality of general heat sources without the emission regulation condition; a plurality of turbines operated by the working fluid heated by passing through the heat exchangers; and a plurality of recuperators introduced with the working fluid passing through the turbine and exchanging heat between the working fluid passing through the turbine and the working fluid passing through the pump to cool the working fluid passing through the turbine.

The emission regulation condition may be a temperature condition.

The number of recuperators may be equal to the number of heat exchangers or may be less than the number of heat exchangers to transfer the working fluid to the heat exchanger and at least one of the recuperators may exchange heat between the working fluid passing through the turbine and the working fluid passing through the pump.

The turbine may include a low pressure turbine operating the pump and a high pressure turbine operating a generator, and a separate transfer pipe through which the working fluid passing through the low pressure turbine and the high pressure turbine, respectively, may be supplied to the plurality of recuperators, respectively.

The recuperators may include first to third recuperators and supply a working fluid $mt_2$ passing through the high pressure turbine to the third recuperator.

The heat exchangers may include a first constrained heat exchanger and a second constrained heat exchanger, and when any one of the first constrained heat exchanger and the second constrained heat exchanger has an emission regulation condition having a temperature higher than that of the other thereof, an integrated flow rate $mt_0$ of the working fluid transferred to the heat exchanger having the emission regulation condition of the higher temperature of the first constrained heat exchanger and the second constrained heat exchanger may be less than the integrated flow rate $mt_0$ of the working fluid transferred to the heat exchanger having the emission regulation condition of the lower temperature thereof.

When the first constrained heat exchanger and the second constrained heat exchanger have an emission regulation condition of the same temperature, the integrated flow rate $mt_0$ of the working fluid may be equally distributed to the first constrained heat exchanger and the second constrained heat exchanger.

The heat exchangers may further include a first heat exchanger and a second heat exchanger, a front end of the pump may be further provided with a cooler cooling the working fluid passing through the recuperator, and a part of the working fluid passing through the pump may be branched from a front end of the recuperator to be supplied to each of the first heat exchanger and the second heat exchanger and heated and then supplied to the low pressure turbine and the high pressure turbine.

The working fluid passing through the first constrained heat exchanger and the second constrained heat exchanger may be introduced into the turbine.

BRIEF DESCRIPTION OF THE DRAWINGS

The above and other features of the present invention will be more clearly understood from the following detailed description taken in conjunction with the accompanying drawings, in which.

DETAILED DESCRIPTION

Figure 1:
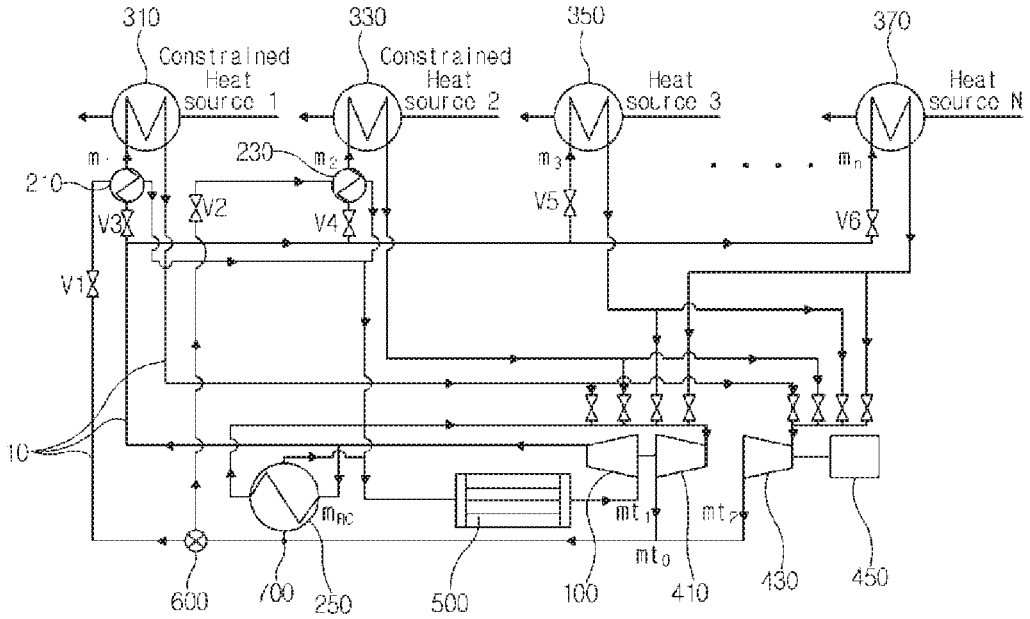
FIG. 1 is a diagram illustrating a supercritical $CO_2$ generation system according to an is exemplary embodiment of the present invention.

Hereinafter, a supercritical $CO_2$ generation system applying plural heat sources according to an exemplary embodiment of the present invention will be described in detail with reference to the accompanying drawings.

Generally, the supercritical $CO_2$ generation system configures a closed cycle in which $CO_2$ used for power generation is not emitted to the outside, and uses supercritical $CO_2$ as a working fluid.

The supercritical $CO_2$ generation system uses supercritical $CO_2$ as a working fluid, thus may use exhaust gas discharged from a thermal power plant, etc. Therefore, the supercritical $CO_2$ generation system may not only be used as a single generation system, but also can be used for a hybrid generation system with a thermal generation system. The working fluid of the supercritical $CO_2$ generation system may be supplied by separating $CO_2$ from the exhaust gas, or separate $CO_2$ may also be supplied.

The supercritical $CO_2$ in the cycle (hereinafter, referred to as working fluid) passes through a compressor, and is then heated while passing through a heat source such as a heater, etc., to become a high-temperature high-pressure working fluid, thereby operating a turbine. A generator or a pump is connected to the turbine and power is generated by the turbine connected to the generator and the pump is operated by using the turbine connected to the pump. The working fluid passing through the turbine is cooled while passing through the heat exchanger, and the cooled working fluid is supplied to the compressor again to circulate in the cycle. The turbine or the heat exchanger may be provided in plural.

The present invention proposes a supercritical $CO_2$ generation system in which a plurality of heaters using waste heat gas are provided as heat sources and each heat exchanger is effectively disposed according to conditions such as an inlet and outlet temperature of the heat source, capacity, the number, etc., such that the same or a smaller number of recuperators as compared to the number of heat sources are operated.

The supercritical $CO_2$ generation systems according to various exemplary embodiments of the present invention include a system in which all working fluids flowing in the cycle are supercritical, and a system in which most working fluids are supercritical and the rest of working fluids are subcritical.

Further, in various exemplary embodiments of the present invention, $CO_2$ is used as a working fluid, and here, $CO_2$ includes carbon dioxide which is chemically pure, carbon dioxide including some impurities in general terms, and a fluid in which carbon dioxide is mixed with one or more fluids as additives.

It is to be noted, in the present invention, that terms "low temperature" and "high temperature" have relative meanings, thus should not be understood as being a temperature higher or lower than a specific reference temperature. Terms "low pressure" and "high pressure" also should be understood as having relative meanings.

FIG. 1 is a schematic diagram illustrating a supercritical $CO_2$ generation system according to an exemplary embodiment of the present invention.

As illustrated in FIG. 1, a supercritical $CO_2$ generation system according to an exemplary embodiment of the present invention may use $CO_2$ as a working fluid, and may be configured to include a pump 100 configured to pass through the working fluid, plural recuperators and plural heat sources configured to exchange heat with the working fluid passing through the pump 100, plural turbines 410 and 430 configured to be driven by the working fluid heated by passing through the recuperators and the heat sources, a power generator 450 configured to be driven by the turbines 410 and 430, and a cooler 500 configured to cool the working fluid introduced into the pump 100.

The respective components of the present invention are connected by a transfer pipe 10 in which a working fluid flows, and it should be understood that the working fluid flows along the transfer pipe 10 even if not particularly mentioned. However, in a case in which a plurality of components are integrated, a part or a region that substantially functions as a transfer pipe 10 will be in the integrated component, thus even in this case, the working fluid should be understood as flowing along the transfer pipe 10. A flow path having a separate function will be additionally described.

The pump 100 is driven by a low pressure turbine 410 to be described below and serves as transmitting the low temperature working fluid cooled by the cooler 500 to the recuperator.

The recuperators 210, 230, and 250 may include a first recuperator 210, a second recuperator 230, and a third recuperator 250. The present embodiment relates to a configuration of a power generation system for a case in which the heat capacity required by the recuperator of an inlet of the heat source is small. Here, the power generation system may be configured to primarily heat a part of the working fluid that has passed through the pump 100 by the first recuperator 210 and then primarily heat the remaining working fluid by the second recuperator 230 and then transfer the heated working fluid to the heat source. Further, the power generation system may be configured to primarily heat a part of the working fluid that has passed through the pump 100 by the third recuperator 250 and then immediately transfer the heated working fluid to the turbines 410 and 430 (the heat capacity of the recuperator will be described below).

The working fluid expanded by passing through the turbines 410 and 430 and cooled from high temperature to medium temperature may be introduced into any one of the first recuperator 210 and the second recuperator 230. The cooled working fluid introduced into the first recuperator 210 and the second recuperator 230 may be heat exchanged with a working fluid passing through the pump 100 to primarily heat the working fluid passing through the pump 100. The working fluid cooled while heating the working fluid passing through the pump 100 is transferred to the cooler 500.

To this end, inlet ends of the first and second recuperators 210 and 230 into which the cooled working fluid passing through the turbines 410 and 430 is introduced may be provided with control valves V1 and V2. The cooled working fluid is transferred to the cooler 500 to be secondarily cooled and transferred to the pump 100.

The working fluid transferred to the first and second recuperators 210 and 230 through the pump 100 is primarily heated by being heat exchanged with the working fluid passing through the turbines 410 and 430, and supplied to heat sources to be described below. To this end, the inlet ends of the transfer pipe 10 through which the working fluid is introduced into each of the first and second recuperators 210 and 230 from the pump 100 may be provided with control valves V3 and V4. In the present invention, the recuperators of which the number is the same as or less than the number of heat sources may be provided, and in the present exemplary embodiment, a case in which the number of recuperators 210, 230, and 250 is three is described by way of example.

The first recuperator 210 is provided before an inlet end through which the working fluid is introduced into a first constrained heat exchanger 310 to be described below, and the second recuperator 230 may be provided before an inlet end through which the working fluid is introduced into a second constrained heat exchanger 330 to be described below. The third recuperator 250 is installed on the transfer pipe 10 branched from a front end of a three way valve 600.

A part of a flow rate $mt_0$ (hereinafter, defined as integrated flow rate) of the fluid that corresponds to sum of a flow rate $mt_2$ of the fluid passing through a high pressure turbine 430 and a flow rate $mt_1$ of the fluid passing through the low pressure turbine 410 is branched and introduced into the first and second recuperators 210 and 230. Further, a part of the integrated flow rate nit of the working fluid is branched and introduced into the third recuperator 250. The inlet end of the first recuperator 210 is provided with the control valve v1 and the second recuperator 230 is provided on another transfer pipe 10 branched from the transfer pipe 10 connected to the first recuperator 210. The inlet end of the second recuperator 230 is also provided with the control valve v2.

A separate controller (not illustrated) controls how much the integrated flow rate $mt_0$ of the working fluid is branched into the plural recuperators 210 to 230 and a branched point of the transfer tube 10 may be provided with a three way valve 600 for branch. Further, a branch point branched toward the third recuperator 250 of the front end of the three way valve 600 may also be provided with a three way valve 700.

The heat source (or indicate the numeral 300 in FIG. 1) may be configured of plural constrained heat sources in which emission conditions of emitted gas are defined and a plurality of general heat sources in which the emission conditions are not defined. The above mentioned emission regulation condition is a temperature condition, and the emission regulation condition may be the same for all heat sources, or may be different for all heat sources.

In the present specification, for convenience, an example in which a first constrained heat exchanger 310 and a second constrained heat exchanger 330 are provided as a constrained heat source and a first heat exchanger 350 and a second heat exchanger 370 are provided as a general heat source will be described.

Further, a flow rate of the working fluid introduced into the first constrained heat exchanger 310 is defined as $m_1$, a flow rate of the working fluid introduced into the second constrained heat exchanger 330 is defined as $m_2$, a flow rate of the working fluid introduced into the first heat exchanger 350 is defined as $m_3$, and a flow rate of the working fluid introduced into an n-th constrained heat exchanger is defined as $m_n$.

The first constrained heat exchanger 310 and the second constrained heat exchanger 330 uses gas (hereinafter, waste heat gas) having waste heat like exhaust gas as the heat source and are heat sources having emission regulations upon the emission of the waste heat gas.

The temperature of the waste heat gas introduced into the first constrained heat exchanger 310 may be relatively lower than that of the waste heat gas introduced into the first heat exchanger 350 to be described later. The first constrained heat exchanger 310 heats the working fluid passing through the first recuperator 210 by heat of the waste heat gas. The waste heat gas losing heat in the first constrained heat exchanger 310 is cooled to a temperature that meets the emission regulation condition, and discharged from the first constrained heat exchanger 310.

The second constrained heat exchanger 330 is also the same heat source as the first constrained heat exchanger 310 and the temperature of the waste heat gas introduced into the second constrained heat exchanger 330 may be relatively lower than that of the waste heat gas introduced into the first heat exchanger 350 to be described later. The second constrained heat exchanger 330 may have emission regulation conditions different from those of the first constrained heat exchanger 310 and may also have the same emission regulation conditions. The second constrained heat exchanger 330 heats the working fluid passing through the second recuperator 230 by heat of the waste heat gas. The waste heat gas from which the heat is taken away by the second constrained heat exchanger 330 is cooled at a temperature meeting the emission regulation condition and then exits the second constrained heat exchanger 330.

The temperature of the waste heat gas used in the first constrained heat exchanger 310 and the second constrained heat exchanger 330 is lower than that of the waste heat gas used in the first heat exchanger 350 and the second heat exchanger 370 or the heat amount of the waste heat gas used in the first constrained heat exchanger 310 and the second constrained heat exchanger 330 may be lower than that of the waste heat gas used in the first heat exchanger 350 and the second heat exchanger 370. The reason is that the first constrained heat exchanger 310 and the second constrained heat exchanger 330 are a heat source with a defined emission regulation condition. As a result, there is a limitation in the heat amount that may be used to meet the emission regulation condition. However, since the first heat exchanger 350 and the second heat exchanger 370 are heat sources for which the emission regulation condition is not defined, there is no limitation in the heat amount that may be utilized, and therefore, the first heat exchanger 350 and the second heat exchanger 370 sufficiently absorbs heat and thus the working fluid may be heated at a high temperature.

The working fluid heated by passing through the first constrained heat exchanger 310 and the second constrained heat exchanger 330 is supplied to the low pressure turbine 410 and the high pressure turbine 430 to drive the turbines 410 and 430. For this purpose, front ends of the turbines 410 and 430 are provided with control valves (not denoted by reference numerals).

The first heat exchanger 350 and the second heat exchanger 370 exchange heat between the waste heat gas and the working fluid to serve to heat the working fluid and are heat sources without the emission regulation conditions. The heat source without the emission regulation conditions may correspond to, for example, an AQC waste heat condition in a cement process. A part of the working fluid that has passed through the pump 100 is first branched to the second recuperator 230 and a part of the flow rate of the working fluid is branched from the front end of the second recuperator 230 to be supplied to the first heat exchanger 350 and the second heat exchanger 370. That is, as the working fluid transferred to the first heat exchanger 350 and the second heat exchanger 370, the working fluid that does not pass through the recuperator is supplied. The front ends of the first heat exchanger 350 and the second heat exchanger 370 are provided with control valves v5 and v6. The working fluid transferred to the first heat exchanger 350 and the second heat exchanger 370 exchanges heat with the waste heat gas to be heated at high temperature. The working fluid heated by passing through the first heat exchanger 350 and the second heat exchanger 370 is supplied to the high pressure turbine 430 and the low pressure turbine 410 to be described below. Alternatively, the working fluid passing through the pump 100 passes through the first recuperator 210 and the second recuperator 230 and then may also be heated by the first constrained heat exchanger 310 and the second constrained heat exchanger 330.

The turbines 410 and 430 include the low pressure turbine 410 and the high pressure turbine 430, and are operated by the working fluid to operate the generator 450 connected to at least any one turbine of the turbines, thereby generating power. Since the working fluid is expanded while passing through the high pressure turbine 430 and the low pressure turbine 410, the turbines 410 and 430 also serve as an expander. In the present exemplary embodiment, the high pressure turbine 430 is connected to the generator 450 to generate power, and the low pressure turbine 410 serves to operate the pump 100.

Here, it is to be noted that terms "high pressure" and "low pressure" have relative meanings, thus should not be understood as being a pressure higher or lower than a specific reference pressure.

If the emission regulation conditions of the first constrained heat exchanger 310 and the second constrained heat exchanger 330 are tight or the flow rate of the waste heat gas introduced is smaller, the heat capacity required by the first constrained heat exchanger 310 and the second constrained heat exchanger 330 is also small.

Here, the case in which the heat capacity of the first constrained heat exchanger 310 and the second constrained heat exchanger 330 is small means the case in which the heat capacity required by the first recuperator 210 and the second recuperator 230 at the inlet ends of the cooling fluid introduced into the first constrained heat exchanger 310 and the second constrained heat exchanger 330 is small. If the heat capacity required by the first recuperator 210 and the second recuperator 230 is small, the flow rates $m_1$ and $m_2$ of the working fluid transferred to the first recuperator 210 and the second recuperator 230 may be decreased. At the same time, a flow rate $m_{RC}$ of the working fluid to be transferred to the third recuperator 250 is increased and thus the medium-temperature working fluid that has passed through the low pressure turbine 410 and the high pressure turbine 430 is supplied to the third recuperator 250 to exchange heat with the working fluid that has passed through the pump 100. The working fluid that has passed through the pump 100 may be supplied to the low pressure turbine 410 and the high pressure turbine 430 immediately after being heated by the third recuperator 250.

That is, the heat capacity required by the first recuperator 210 and the second recuperator 230 is small, and therefore a small amount of the working fluid is supplied, and a large amount of the working fluid is transferred to the third recuperator 250, such that the heat amount of the integrated flow rate $mt_0$ of the working fluid may be used sufficiently.

Therefore, as the first recuperator 210 and the second recuperator 230, a plurality of small-capacity recuperators may be used and as the third recuperator 250, a small number of large-capacity recuperators may be used. The number of small-capacity recuperators may be equal to the number of first constrained heat exchanger 310 and second constrained heat exchangers 330.

In this case, a part of the integrated flow rate $mt_0$ of the working fluid is equally distributed and transferred to the first recuperator 210 and the second recuperator 230, thereby heating the working fluid while satisfying the emission regulation conditions of the waste heat gas.

In the supercritical $CO_2$ generation system according to the exemplary embodiment of the present invention having the above described configuration, a flow of the working fluid will be described by way of specific example as follows.

The working fluid cooled by the cooler 500 is circulated by the pump 100 to be branched and transferred to the first recuperator 210 and the second recuperator 230, respectively, through the control valves v3 and v4. The flow rate $m_1$ of the working fluid transferred to the first recuperator 210 and the flow rate $m_2$ of the working fluid transferred to the second recuperator 230 may be different from each other according to the emission regulation conditions of the first and second constrained heat exchangers 310 and 330.

The working fluid passing through the pump 100 and then branched to the first recuperator 210 and the second recuperator 230, respectively, is heat exchanged with the working fluid branched from the integrated flow rate $mt_0$ of the working fluid passing through the low pressure turbine 410 and the high pressure turbine 430 and passing through the first recuperator 210 and the second recuperator 230, respectively, to be primarily heated.

Thereafter, the working fluid that has passed through the first recuperator 210 is transferred to the first constrained heat exchanger 310 and exchanges heat with the waste heat gas to be secondarily heated and then supplied to the low pressure turbine 410 and the high pressure turbine 430.

The working fluid transferred to the second recuperator 230 is again branched from the front end of the second recuperator 230 and transferred to the second recuperator 230, the first heat exchanger 350, and the second heat exchanger 370.

The working fluid transferred to the second constrained heat exchanger 330 is exchanged heat with the waste heat gas to be secondarily heated and then transferred to the low pressure turbine 410 and the high pressure turbine 430. The working fluid transferred to the first heat exchanger 350 and the second heat exchanger 370 is branched from the front end of the first heat exchanger 350 and transferred to the first heat exchanger 350 and the second heat exchanger 370. The working fluid heated by the first heat exchanger 350 and the second heat exchanger 370 is transferred to the low pressure turbine 410 and the high pressure turbine 410.

At this point, the emission regulation conditions of the waste heat gas of the first and second constrained heat exchangers 310 and 330 may be similar to about 200° C. The emission regulation conditions are similar, and therefore the integrated flow rate $mt_0$ of the working fluid may equally be divided and thus may be transferred to the first constrained heat exchanger 310 and the second constrained heat exchanger 330. If the emission regulation conditions of the first constrained heat exchanger 310 and the second constrained heat exchanger 330 are different, the integrated flow rate $mt_0$ of the working fluid may be less transferred to the constrained heat source having a higher temperature. That is, the heat exchange with a smaller flow rate of working fluid is generated and thus the heat exchange may be less generated in the constrained heat source that emits the waste heat gas at higher temperature.

Further, the waste heat gas introduced into the first constrained heat exchanger 310 and the second constrained heat exchanger 330 may be middle-temperature waste heat gas relatively lower than the temperature of the waste heat gas introduced into the first heat exchanger 350 and the second heat exchanger 370.

The middle-temperature working fluid heated by the first and second constrained heat exchangers 310 and 330 and the high-temperature working fluid passing through the first heat exchanger 350 and the second heat exchanger 370 are also transferred to the low pressure turbine 410 or the high pressure turbine 430 to drive the turbines 410 and 430. The above-mentioned controller determines which of the turbines 410 and 430 is driven by the middle-temperature or high-temperature working fluid depending on operation conditions.

Alternatively, the working fluid may be directly transferred to the third recuperator 250 through the pump 100 without passing through the first and second recuperators 210 and 230. The low-temperature working fluid is heated by passing through the high-capacity third recuperator 250 capable of supplying a larger heat amount as compared with the first recuperator 210 and the second recuperator 230 and is then transferred to the low pressure turbine 410 or the high pressure turbine 430 to drive the turbines 410 and 430.

The integrated flow rate $mt_0$ of the middle-temperate working fluid expanded by passing through the low pressure turbine 410 and the high pressure turbine 430 is supplied while being branched into the first recuperator 210 to the third recuperator 250 and is cooled by exchanging heat with the low-temperature working fluid passing through the pump 100 and then is introduced into the cooler 500.

Here, it is to be noted that terms "low temperature", "medium temperature", and "high temperature" have relative meanings, thus should not be understood as being a temperature higher or lower than a specific reference temperature.

Generally, an output of the high pressure turbine 430 operating the generator needs to be larger than that of the low pressure turbine 410 operating the pump 100, thus it is preferable that working fluid in a medium temperature state by passing through the first and second constrained heat exchangers 310 and 330 is transferred to the low pressure turbine 410. As a result, the working fluid passing through the first heat exchanger 350 and the second heat exchanger 370 that are in the relatively higher temperature state than the first constrained heat exchanger 310 and the second constrained heat exchanger 330 is preferably transferred to the high pressure turbine 430.

However, to which turbine 410 or 430 the medium temperature working fluid or the high temperature working fluid is transferred may be determined according to the operation condition or the emission regulation condition of the waste heat gas.

Hereinabove, an exemplary embodiment in which the integrated flow rate of the working fluid passing through the low pressure turbine and the high pressure turbine is branched and transferred to the first and second recuperators has been described, but each flow rate of the low pressure turbine and the high pressure turbine may also be transferred to the first and second recuperators (the same configuration as the above described exemplary embodiment will be described using the same reference numerals, and detailed description thereof will be omitted).

Figure 2:
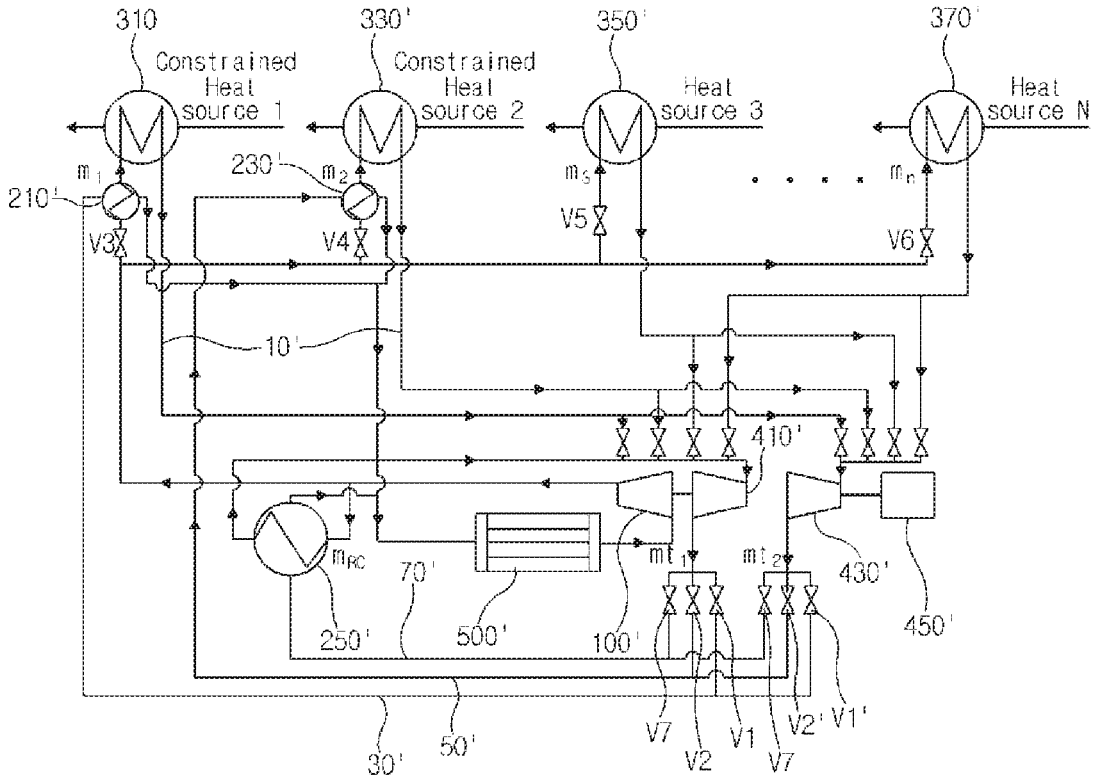
FIG. 2 is a diagram illustrating a supercritical $CO_2$ generation system according to another exemplary embodiment of the present invention.

FIG. 2 is a diagram illustrating a supercritical $CO_2$ generation system according to another exemplary embodiment of the present invention.

As illustrated in FIG. 2, the supercritical $CO_2$ generation system according to another exemplary embodiment of the present invention may transfer a working fluid $mt_1$ passing through a low pressure turbine 410' to first and second recuperators 210' and 230' and transfer a working fluid $mt_2$ passing through a high pressure turbine 430' to a third recuperator 250'. At this point, control valves are provided at an output end of the low pressure turbine 410' and an output end of the high pressure turbine 430', respectively, and a transfer pipe connecting between the output end of the low pressure turbine 410' and a rear end of the control valve is connected to transfer pipes each connected to the first to third recuperators 210' to 250'.

That is, a valve V1 is installed at the output end of the low pressure turbine 410', a control valve V1' is installed at the output end of the high pressure turbine 430', and a transfer pipe 30' connects between the control valve V1' of the high pressure turbine 430' side and the first recuperator 210' to each other. The rear end of the control valve V1' is connected to the transfer pipe 30'. A valve V2 is installed at the output end of the low pressure turbine 410', a control valve V2' is installed at the output end of the high pressure turbine 430', and a transfer pipe 50' connects between the control valve V2' of the high pressure turbine 430' side and the second recuperator 230' to each other. A rear end of the control valve V2' is connected to the transfer pipe 50'. A valve V7 is installed at the output end of the low pressure turbine 410', a control valve V7' is installed at the output end of the high pressure turbine 430', and a transfer pipe 70' connects between the control valve V7' of the high pressure turbine 430' side and the third recuperator 250' to each other. A rear end of the control valve V7' is connected to the transfer pipe 70'.

For example, the case in which the emission regulation condition of the first constrained heat exchanger 310' is 220° C. and the emission regulation condition of the second constrained heat exchanger 330' is 200° C. may be assumed. In this case, as in the above-described embodiment, the emission regulation conditions may be satisfied through the branched amount of the integrated flow rate $mt_0$.

That is, a flow rate of the working fluid discharged from the high-pressure turbine 430' to which a relatively higher temperature working fluid as compared to the low pressure turbine 410' is supplied in order to operate a generator 450', less (it is not clear) than that of the working fluid of the low pressure turbine 410' is supplied to the high-capacity third recuperator 250' through the transfer pipe 70', such that the heat exchange may be larger generated in the first and second recuperators 210' and 230' due to the large temperature difference.

Further, the flow rate of the working fluid discharged from the low pressure turbine 410' to which the working fluid having a relatively lower temperature than that of the high pressure turbine 430' is supplied is larger than that of the working fluid of the high pressure turbine 430 through the separate transfer pipe 30' and is transferred to the first and second constrained heat exchangers 310' and 330' through the transfer pipes 30' and 50', thereby satisfying the emission regulation conditions of the waste heat gas of the first and second constrained heat exchangers 310' and 330', respectively. The working fluid discharged from the low pressure turbine 410' is also supplied to the first heat exchanger 350' and the second heat exchanger 370' which have no restriction on the absorption of heat amount, so that the heat exchange with the waste heat gas is more generated in the first and second heat exchangers 310' and 330'.

Alternatively, the emission regulation conditions of the heat sources may also be satisfied by a method in which only the working fluid of the high pressure turbine 430' is transferred to the third recuperator 250' and only the working fluid of the low pressure turbine 410' is transferred to the first and second recuperators 210' and 230'.

In the supercritical $CO_2$ generation system applying plural heat sources according to an exemplary embodiment of the present invention, each heat exchanger is effectively disposed according to conditions such as an inlet and outlet temperature, capacity, the number, etc., of the heat source, such that it is possible to use the same or smaller number of recuperators as compared to the number of heat sources, thereby simplifying the system configuration and implementing effective operation.

The exemplary embodiments of the present invention described above and illustrated in the drawings should not be interpreted as limiting the technical idea of the present invention. The scope of the present invention is limited only by the accompanying claims, and those skilled in the art may modify and change the technical idea of the present invention in various forms. Therefore, it is obvious to those skilled in the art that these alterations and modifications fall within the scope of the present invention.

What is claimed is:

1. A supercritical $CO_2$ generation system applying plural heat sources, comprising:

a pump circulating a working fluid;

a plurality of heat exchangers heating the working fluid and including a plurality of constrained heat sources having an emission regulation condition of an outlet end thereof and a plurality of general heat sources without the emission regulation condition;

a plurality of turbines operated by the working fluid heated by passing through the heat exchangers; and a plurality of recuperators cooling the working fluid passing through the turbines by heat exchange between the working fluid passing through the turbines and the working fluid passing through the pump, wherein the working fluid passing through the turbines is branched into the recuperators, respectively, and wherein each of the plurality of turbines is configured to be connected to each of the plurality of heat exchangers.

2. The supercritical $CO_2$ generation system applying plural heat sources of claim 1, wherein the emission regulation condition is a temperature condition.

3. The supercritical $CO_2$ generation system applying plural heat sources of claim 2, wherein a number of the recuperators is equal to a number of the heat exchangers or is less than the number of the heat exchangers to transfer the working fluid to the heat exchanger and at least one of the recuperators exchanges heat between the working fluid passing through the turbine and the working fluid passing through the pump.

4. The supercritical $CO_2$ generation system applying plural heat sources of claim 3, wherein the turbines include a low pressure turbine operating the pump and a high pressure turbine operating a generator, and an integrated flow rate $mt_0$ of the working fluid passing through the low pressure turbine and the high pressure turbine is branched and supplied to the plurality of recuperators.

5. The supercritical $CO_2$ generation system applying plural heat sources of claim 4, wherein the recuperators include a first recuperator, a second recuperator, and a third recuperator, and the system further includes a branch point branched from rear ends of the low pressure turbine and the high pressure turbine to the third recuperator, and a three way valve provided at a rear end of the branch point and feeding the working fluid passing through the branch point to the first recuperator and the second recuperator, respectively.

6. The supercritical $CO_2$ generation system applying plural heat sources of claim 5, wherein the heat exchangers include a first constrained heat exchanger and a second constrained heat exchanger, and when any one of the first constrained heat exchanger and the second constrained heat exchanger has an emission regulation condition having a temperature higher than that of the other thereof, the integrated flow rate $mt_0$ of the working fluid transferred to the heat exchanger having the emission regulation condition of the higher temperature of the first constrained heat exchanger and the second constrained heat exchanger is less than the integrated flow rate $mt_0$ of the working fluid transferred to the heat exchanger having the emission regulation condition of the lower temperature thereof.

7. The supercritical $CO_2$ generation system applying plural heat sources of claim 6, wherein the heat exchangers further include a first heat exchanger and a second heat exchanger, a front end of the pump is further provided with a cooler cooling the working fluid passing through the recuperators, a part of the working fluid passing through the pump is branched from a front end of the second recuperator to be supplied to each of the first heat exchanger and the second heat exchanger and heated and then supplied to the low pressure turbine and the high pressure turbine, and the working fluid passing through the first constrained heat exchanger and the second constrained heat exchanger is introduced into one of the low pressure turbine and the high pressure turbine.

8. The supercritical $CO_2$ generation system applying plural heat sources of claim 5, wherein the heat exchangers include a first constrained heat exchanger and a second constrained heat exchanger, and when the first constrained heat exchanger and the second constrained heat exchanger have an emission regulation condition of the same temperature, the integrated flow rate $mt_0$ of the working fluid is equally distributed to the first constrained heat exchanger and the second constrained heat exchanger.

9. The supercritical $CO_2$ generation system applying plural heat sources of claim 8, wherein the heat exchangers further include a first heat exchanger and a second heat exchanger, a front end of the pump is further provided with a cooler cooling the working fluid passing through the recuperators, a part of the working fluid passing through the pump is branched from a front end of the second recuperator to be supplied to each of the first heat exchanger and the second heat exchanger and heated and then supplied to the low pressure turbine and the high pressure turbine, and the working fluid passing through the first constrained heat exchanger and the second constrained heat exchanger is introduced into one of the low pressure turbine and the high pressure turbine.

10. A supercritical $CO_2$ generation system applying plural heat sources, comprising:

a pump circulating a working fluid;

a plurality of heat exchangers heating the working fluid and including a plurality of constrained heat sources having an emission regulation condition of an outlet end thereof and a plurality of general heat sources without the emission regulation condition;

a plurality of turbines operated by the working fluid heated by passing through the heat exchangers; and a plurality of recuperators introduced with the working fluid passing through the turbines and exchanging heat between the working fluid passing through the turbines and the working fluid passing through the pump to cool the working fluid passing through the turbines, wherein each of the plurality of turbines is configured to be connected to each of the plurality of heat exchangers.

11. The supercritical $CO_2$ generation system applying plural heat sources of claim 10, wherein the emission regulation condition is a temperature condition.

12. The supercritical $CO_2$ generation system applying plural heat sources of claim 10, wherein a number of the recuperators is equal to a number of the heat exchangers or is less than the number of the heat exchangers to transfer the working fluid to the heat exchanger and at least one of the recuperators exchanges heat between the working fluid passing through the turbine and the working fluid passing through the pump.

13. The supercritical $CO_2$ generation system applying plural heat sources of claim 12, wherein the turbines include a low pressure turbine operating the pump and a high pressure turbine operating a generator, and a separate transfer pipe through which the working fluid passing through the low pressure turbine and the high pressure turbine, respectively, is supplied to the plurality of recuperators, respectively.

14. The supercritical $CO_2$ generation system applying plural heat sources of claim 13, wherein the recuperators include a first recuperator, a second recuperator, and a third recuperator, and supply a working fluid $mt_2$ passing through the high pressure turbine to the third recuperator.

15. The supercritical $CO_2$ generation system applying plural heat sources of claim 14, wherein the heat exchangers include a first constrained heat exchanger and a second constrained heat exchanger, and when any one of the first constrained heat exchanger and the second constrained heat exchanger has an emission regulation condition having temperature higher than that of the other thereof, an integrated flow rate $mt_0$ of the working fluid transferred to the heat exchanger having the emission regulation condition of the higher temperature of the first constrained heat exchanger and the second constrained heat exchanger is less than the integrated flow rate $mt_0$ of the working fluid transferred to the heat exchanger having the emission regulation condition of the lower temperature thereof.

16. The supercritical $CO_2$ generation system applying plural heat sources of claim 15, wherein the heat exchangers further include a first heat exchanger and a second heat exchanger, a front end of the pump is further provided with a cooler cooling the working fluid passing through the recuperators, and a part of the working fluid passing through the pump is branched from a front end of the recuperators to be supplied to each of the first heat exchanger and the second heat exchanger and heated and then supplied to the low pressure turbine and the high pressure turbine.

17. The supercritical $CO_2$ generation system applying plural heat sources of claim 16, wherein the working fluid passing through the first constrained heat exchanger and the second constrained heat exchanger is introduced into the turbines.

18. The supercritical $CO_2$ generation system applying plural heat sources of claim 14, wherein the heat exchangers include a first constrained heat exchanger and a second constrained heat exchanger, and when the first constrained heat exchanger and the second constrained heat exchanger have an emission regulation condition of the same temperature, an integrated flow rate $mt_0$ of the working fluid is equally distributed to the first constrained heat exchanger and the second constrained heat exchanger.

19. The supercritical $CO_2$ generation system applying plural heat sources of claim 18, wherein the heat exchangers further include a first heat exchanger and a second heat exchanger, a front end of the pump is further provided with a cooler cooling the working fluid passing through the recuperators, and a part of the working fluid passing through the pump is branched from a front end of the recuperators to be supplied to each of the first heat exchanger and the second heat exchanger and heated and then supplied to the low pressure turbine and the high pressure turbine.

20. The supercritical $CO_2$ generation system applying plural heat sources of claim 19, wherein the working fluid passing through the first constrained heat exchanger and the second constrained heat exchanger is introduced into the turbines.

* * * * *